United States Patent [19]

Yuito et al.

[11] 4,008,412

[45] Feb. 15, 1977

[54] THIN-FILM FIELD-EMISSION ELECTRON SOURCE AND A METHOD FOR MANUFACTURING THE SAME

[75] Inventors: Isamu Yuito, Hachioji; Kikuji Sato, Kokubunji; Mikio Hirano, Ohme, all of Japan

[73] Assignee: Hitachi, Ltd., Japan

[22] Filed: Aug. 18, 1975

[21] Appl. No.: 605,603

[30] Foreign Application Priority Data

Aug. 16, 1974 Japan ..... 49-93297

[52] U.S. Cl. ..... 313/309; 29/580; 313/336; 313/351

[51] Int. Cl.[2] ..... H01J 1/02

[58] Field of Search ..... 313/309, 336, 351; 156/3, 17, 11; 29/580

[56] References Cited

UNITED STATES PATENTS

| | | | |
|---|---|---|---|
| 3,453,478 | 7/1969 | Shoulders et al. | 313/336 X |
| 3,500,102 | 3/1970 | Crost et al. | 313/309 X |
| 3,665,241 | 5/1972 | Spindt et al. | 313/309 |
| 3,671,798 | 6/1972 | Lees | 313/309 |
| 3,755,704 | 8/1973 | Spindt et al. | 313/309 |
| 3,814,968 | 6/1974 | Nathanson et al. | 313/309 |
| 3,855,499 | 12/1974 | Yamada et al. | 313/336 |
| 3,921,022 | 11/1975 | Levine | 313/309 |
| 3,970,887 | 7/1976 | Smith et al. | 313/309 |

*Primary Examiner*—Saxfield Chatmon, Jr.
*Attorney, Agent, or Firm*—Craig & Antonelli

[57] ABSTRACT

A thin-film field-emission electron source having an emitter within a minute cavity in a conductive substrate, an insulating layer covering the surface of the substrate except for the portion of the cavity, and a first anode layer on the insulating layer, wherein the substrate and the emitter are comprised as one body, and the insulating layer and the first anode layer overhang the cavity, except directly over the emitter.

This electron source may be manufactured by the method comprising the steps of i) forming a sandwich structure of the substrate-insulating layer-first anode layer, ii) forming a closed loop opening at a predetermined position on the surface of the first anode layer, iii) etching the insulating layer with the use of the first anode layer as a mask and iv) forming an emitter and a cavity by etching the substrate with the use of the insulating layer as a mask.

This thin-film field-emission electron source can be manufactured very readily and has good insulation between the emitter and the first anode layer.

19 Claims, 21 Drawing Figures

THIN-FILM FIELD-EMISSION ELECTRON SOURCE AND A METHOD FOR MANUFACTURING THE SAME

BACKGROUND OF THE INVENTION

1. Field of the Invention

The present invention relates to a thin-film field-emission electron source and, more particularly, to a thin-film field-emission electron source which is manufactured by etching layer by layer a sandwich structure of the substrate-insulating layer-first anode layer.

2. Brief Description of the Prior Art

In general, a thin-film field-emission electron source, which will be referred to as MFE (an abridgement of "micro-field-emission type electron source"), has a structure which comprises a first anode 1 and a needlelike emitter 3 which is arranged very closely (for example less than about 10 $\mu$m) to the first anode as is shown in FIG. 1. A MFE is a kind of cold cathode in which the field emission phenomenon is utilized. Electrons are emitted from the emitter, the tip of which is in a strong electric field, by applying a relatively low voltage between the first anode 1 and the emitter 3. Furthermore, there is an insulating layer 2 between the first anode 1 and a substrate 4 which is constructed as one body with the emitter 3.

Heretofore, there have been many problems concerning the formation of the first anode and the emitter in manufacturing MFE's. In that connection, the etching method shown in FIG. 2(*a*) to FIG. 2(*d*) will be explained hereunder.

The formation of an insulating layer 2 on a conductive substrate 4 which may also be an insulating substrate having a deposited conductive layer of a predetermined thickness thereon, precedes an etching procedure of the insulating layer 2. This etching is carried out by a well known photoetching technique so as to make the insulating layer form a suitable pattern according to the desired shape of the emitter produced hereafter, for example a circlelike insulating layer on the substrate as is shown in FIG. 2(*b*). FIG. 2(*a*) illustrates the double layer of the substrate 4 and the insulating layer 2 produced in the former step. The conductive substrate 4 is then etched with the use of the circlelike insulating layer as a mask. The etching phenomenon thereby advances simultaneously in a direction perpendicular as well as parallel to the face of the substrate, and the portion under the circlelike insulating layer is etched as illustrated in FIG. 2(*c*). Therefore, an emitter having a sharp tip can be formed. FIG. 2(*d*) illustrates the completely formed emitter with substrate. However, there is no first anode formed close to the emitter, which is necessary in order to act as a MFE. Accordingly, it is necessary to provide a first anode near the emitter. This procedure has the great disadvantage that the alignment of the first anode with the emitter is very difficult in practice although it can be obtained theoretically.

Another previous method for manufacturing MFE's is illustrated in FIG. 3(*a*) to FIG. 3(*e*). This method includes the following steps: i) forming a first conductive layer 5, an insulating layer 2 and a second conductive layer 1 on a substrate 4, in this order, as is shown in FIG. 3(*a*), ii) etching the second conductive layer 1 so as to form at least one circular opening at a predetermined position, iii) etching the insulating layer 2 employing the second conductive layer having the opening as a mask, so as to form at least one circular opening reaching the predetermined position on the first conductive layer 5 as is shown in FIG. 3(*b*), and iv) forming the emitter, having a sharp tip, in the opening. In this method, the shape of the opening in the insulating layer 2 is an inverse turncated cone, and the diameter $d_1$ of the opening in the second conductive layer 1 is smaller than the upper base diameter of the turncated cone. The second conductive layer 1 overhangs the opening of the insulating layer 2. In the above-mentioned step iv), the emitter 3 is deposited by the simultaneous evaporation method of mask material 8 and emitter material 7. These two materials are evaporated by oblique evaporation and normal evaporation respectively. During the simultaneous evaporation, the substrate 4 is rotated. The mask material 8 is deposited on the second conductive layer 1 forming a gradually closing opening, the diameter of which becomes smaller from $d_1$ to $d_2$ as is illustrated in FIG. 3(*c*). Therefore, the depositing area of the simultaneously evaporated emitter material 7 decreases with decreasing diameter of the mask opening. Finally, the opening of the second conductive layer 1 is closed by the deposited mask material 6 and an emitter with a sharp tip is formed as is shown in FIG. 3(*d*). Then, the oblique evaporated material 6 which is a mixture of mask material 8 and emitter material 7 is selectively dissolved and removed. As the result, there is obtained a MFE having an emitter 3 with a sharp tip and a first anode 1. FIG. 3(*e*) shows this resulting MFE. However, this method has many difficulties in that i) the character of the emitter material changes because of the mixing of the mask material with the emitter material by the simultaneous evaporation, ii) selective removal of the mask material layer 6 is necessary and iii) the apparatus for the simultaneous vacuum evaporation of the two materials is very complicated, and so on. Furthermore, MFE's produced according to this method, and having the structure illustrated in FIG. 3(*e*), have great difficulties in that the surface 2' of the insulating layer is open to dielectric breakdown of the insulation because of frequent contamination of the surface 2' during operation. Indeed, the insulation between the emitter 3 and the first anode 1 depends greatly on the insulating character at the surface 2' of the insulating layer 2.

SUMMARY OF THE INVENTION

The object of the present invention is to overcome the above-mentioned difficulties with the structure and production of prior MFE. Namely, it is an object of the present invention to provide a trouble-free MFE having improved insulation between the emitter and the first anode. Another object of the present invention is to provide a novel method for producing the aforementioned MFE's without difficulty.

To achieve the above-mentioned objects, the thin-film field-emission electron source of the present invention has a needlelike emitter within a minute cavity in a conductive substrate, an insulating layer on the surface of the substrate except for the portion of the cavity, and a first anode layer on the insulating layer, wherein said substrate and said emitter are comprised as one body, and said insulating layer and said first anode layer overhang said cavity around the projection of said emitter except directly over said emitter.

The method of the present invention for producing said electron source comprises the following steps: i) forming an insulating layer on a conductive substrate, ii) forming a first anode layer made of conductive material on said insulating layer to provide a sandwich structure of the substrate-insulating layer-first anode layer, iii) forming a closed loop opening (i.e. an annular opening) at a predetermined position on said first anode layer by the well known photo-etching technique, wherein said opening reaches to the surface of said insulating layer, iv) etching said insulating layer, employing said first anode layer as a mask to form a closed loop opening (i.e. an annular opening) under the first anode opening provided in step iii), wherein said opening reaches to the surface of said substrate, and v) etching said substrate, employing said insulating layer as a mask to form a cavity and a needlelike emitter which is under the level of said insulating layer and the projection of which is surrounded by said opening of said insulating layer, and to thereby remove portions of said insulating layer and first anode layer which are surrounded by said openings, and to thereby generate a large opening in said insulating layer.

Said substrate may also be made of an insulating plate, such as a sapphire plate, on which a conductive layer is formed. In the case of this composite substrate, said emitter is made from the conductive layer on the insulating plate and is electrically connected thereto. Accordingly, the thickness of said conductive layer must be greater than the height of said emitter.

Suitable materials for the conductive substrate are, for example, Si, W, W alloyed with Th, Mo and so on. It is desirable for the conductive substrate material to have both electric conductivity and a low work function.

Dense and hard insulating materials having appropriate dielectric breakdown voltages and high melting temperatures, such as $SiO_2$, $TiO_2$, $Ia_2O_5$, $Y_2O_3$, $Si_3N_4$, AlN, alumina and heat resisting glass, are preferably used for said insulating layer. These insulating materials are provided on the conductive substrate by the well known chemical vapor deposition method, thermal oxydization method or sputtering method. Generally, the thickness of the insulating layer is 0.4 $\mu$m to 5 $\mu$m. The material and the thickness of said insulating layer must be selected so as to have a dielectric breakdown voltage of higher than 100 V because they relate to the insulation between said emitter and first anode.

The material for said first anode layer must be conductive, and is generally formed by the evaporation method. The desirable thickness of the first anode layer ranges from 0.1 $\mu$m to 2 $\mu$m in MFE's manufactured according to the aforementioned method. The excessively thick layers have difficulty during the photoetching. In the method shown by FIGS. 6(*a*) to 6(*d*) and disclosed later, the desirable range of the first anode layer is from 0.04 $\mu$m to 1 $\mu$m. In the case of the production method mentioned above, the material of said first anode layer must be determined according to the kind of etchant of said insulating layer and said substrate. For example, if the etchant is hydrofluoric acid aqueous solution, a hydrofluoric acid resisting conductor, for example, Cr, Au, Ni and their alloys are desirable for the material of said first anode material.

Physical etching techniques such as plasma gas etching, ion etching and sputter etching may be used in place of the conventional chemical etching technique for the etching of at least one of said first anode layer, insulating layer, and substrate. An etching method combining these techniques may also be used. However, in general, only the chemical etching technique is used.

Furthermore, in the method for manufacturing said electron source, electron emissive material layers may be deposited on said first anode layer and said emitter to improve the electron emission of said emitter after the aforesaid step v). The electron emissive material on the first anode layer is not necessary, but it is naturally deposited thereon by the vacuum evaporation step which might be used in such procedures.

The typical material for said electron emissive material is $LaB_6$, but there may also be used for this purpose barium oxide compounds such as (Ba,Sr)O and (BaO-SrO-CaO), calcium oxide compounds such as (Ca,Sr)O, boron compounds such as $LaB_6$, $CaB_6$, $SrB_6$, $BaB_6$, and $CeB_6$, lanthanum boride compounds such as $(La,Sr)B_6$, $(La,Ba)B_6$ and $(La,Eu)B_6$, cerium boride compounds such as $(Ce,Sr)B_6$, $(Ce,Ba)B_6$ and $(Ce,Eu)B_6$, praseodymium boride compounds such as $(Pr,Sr)B_6$, $(Pr,Ba)B_6$ and $(Pr,Eu)B_6$, neodymium boride compounds such as $(Nd,Sr)B_6$, $(Nd,Ba)B_6$ and $(Nd,Eu)B_6$, europium boride compounds such as $(Eu,Sr)B_6$, $(Eu,Ba)B_6$, and so on. These compounds are all hard, and have a low work function and a high melting point.

The above-mentioned electron emissive materials are also used as a conductive layer formed on the insulating plate of the aforementioned composite substrate. The aforesaid conductive substrate materials such as Si, W, W alloyed with Th, Mo or the like are used for this conductive layer too.

Another method of the present invention for producing said electron source comprises the following steps: i') forming an insulating layer on a conductive substrate, ii') forming a closed loop opening at a predetermined position on said insulating layer by the well known photo-etching technique, wherein said opening reaches to the surface of said substrate, iii') etching said substrate, employing said insulating layer as a mask, to form a cavity and a needlelike emitter which is under the level of said insulating layer and the projection of which is surrounded by said opening of said insulating layer, and thereby removing the portion of said insulating layer which is surrounded by said opening, and iv') depositing an electron emissive material simultaneously on said insulating layer and on said emitter to form a first anode layer on said insulating layer improving the electron emissivity of said emitter. The aforesaid electron emissive materials such as $LaB_6$, barium oxide compounds, calcium oxide compounds and many boride compounds may be used as said electron emissive material in this step (iv'). Other matters described in the foregoing paragraph about the substrate, the insulating layer and the emitter may also be applied to this method. The thickness of the deposited emissive material layer in this step (iv') should preferably range from 0.04 $\mu$m to 1.0 $\mu$m. Accordingly, in this method, the thickness of the first anode layer is in the range. In both methods, the shape and sharpness of the needlelike emitter and the degree of overhang of the first anode layer and/or the insulating layer over the cavity are suitably controlled by the stirring of the etching solution and by the etching time. It is preferably to have an overhang of greater than 0.5 $\mu$m, and more preferable to have one greater than 1 $\mu$m. The diameter, or side, of the cavity in the substrate may be 2.5 to 10 $\mu$m. Furthermore, the diameter, or side, of said large opening of said insulating layer is preferably in the range from 1.5 μm to 5 μm, and more preferably from 2.5 μm to 3.5 μm. When it is smaller than this, it becomes difficult for gas generated in the cavity during operation to escape. When, on the contrary, it is too large, the gradient of the electric field about the tip of the emitter becomes dull. Both cases are undesirable for a good electron source.

If necessary, there can be formed an electron source comprising plural emitters and first anodes on a single substrate, according to the method of the present invention. Even several thousand emitters and first anodes may be manufactured simultaneously on one substrate, if desired.

The above-mentioned thin-film field-emission electron source according to the present invention has excellent properties and no difficulties in manufacturing. Accordingly, it is very suitable for the cathode of a quick starting Braun tube, a display tube, an electron-microscope and so on.

The excellent properties of this MFE, such as good insulation between the emitter and the first anode layer, depend on a structure which has an insulating layer with a long surface between the conductive substrate surrounding the emitter and the first anode layer. Furthermore, a thin-film field-emission electron source having a good alignment of the first anode with the emitter can be readily obtained according to the method of the present invention because of the self-alignment thereof in the etching steps, and/or the electron emissive material depositing step. Accordingly, an extremely high precision of disposition of the first anode and the emitter is obtainable with no resulting inferior products due to excessively short length of the surface of the insulating layers between the conductive substrate and the first anode. The excessively short distance thereof arises from a misalignment of the first anode with the emitter.

Other features and advantages of the invention will be apparent from the following description in connection with the accompanying drawings.

DESCRIPTION OF THE PRESENTLY PREFERRED EMBODIMENTS

EXAMPLE 1

FIGS. 4*a* to 4*d* illustrate the method for manufacturing a MFE in this example.

Figure 4A:
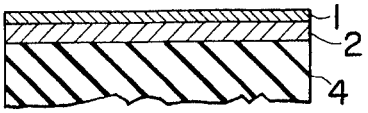
FIGS. 4*a* to 4*d* are cross-sectional views illustrating the structure of a MFE and the manufacturing steps thereof in an embodiment of the present invention.
Figure 4B:
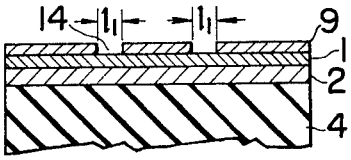

FIG. 4*a* shows the state before forming the first anode and the emitter. Namely, an insulating layer 2 made of $SiO_2$ film or $Al_2O_3$ film was deposited on a conductive substrate 4 made of Si by the well known chemical vapor deposition method, thermal oxydization method or sputtering method to a thickness of 0.4 to 5μm, then a conductive layer 1 used for the first anode was deposited on the insulating layer 2 by the evaporation method. Next, as is shown in FIG. 4*b*, there was formed on the conductive layer 1 a photo-resist film 9 having a closed loop opening 14 of a predetermined pattern, at a predetermined position. The shape of the opening 14 was either circular or square when viewed from the topside, and the width, $l_1$ thereof was 0.3 to 3 μm. The conductive layer 1 was exposed at the closed loop opening portion 14.

Figure 4C:
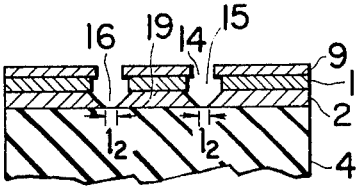

Next, the conductive layer 1 was etched employing the photo-resist film 9 with the opening 14 as a mask, and the insulating layer 2 was also etched employing the conductive layer 1 as a mask to thereby expose the substrate 4 at the closed loop opening portion 16. As is shown at FIG. 4*c*, there was formed on the conductive layer 1 a closed loop opening 15 with a width slightly broader than the width $l_1$ of the opening 14 of the photo-resist film 9 and on the insulating layer 2 a closed loop opening 16, the cross-section of which had an inverse turncated conelike shape with an upper side slightly longer than the width of the opening 15.

Figure 1:
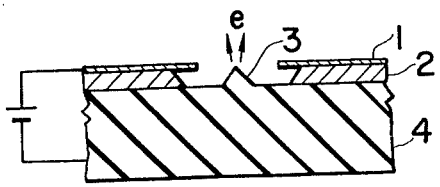
FIG. 1 PRIOR ART
FIG. 1 is a cross-sectional view illustrating the main structure of a MFE.
Figure 2A:
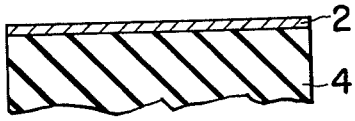
FIG. 2a PRIOR ART
FIGS. 2*a* to 2*d* are diagrammatic illustrations of one previous method for manufacturing a MFE by the etching method.
Figure 2B:
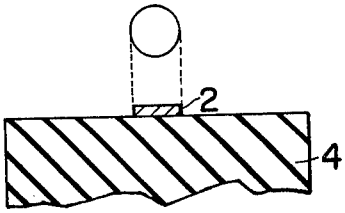
FIG. 2b PRIOR ART
Figure 2C:
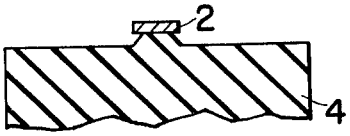
FIG. 2c PRIOR ART
Figure 2D:
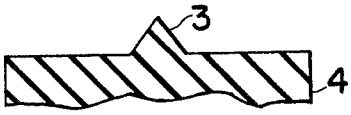
FIG. 2d PRIOR ART
Figure 3A:
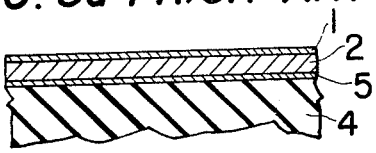
FIG. 3a PRIOR ART
FIGS. 3*a* to 3*e* are diagrammatic illustrations of another previous method for manufacturing a MFE.
Figure 3B:
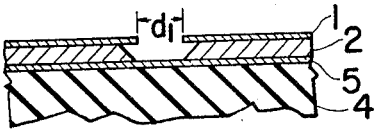
FIG. 3b PRIOR ART
Figure 3C:
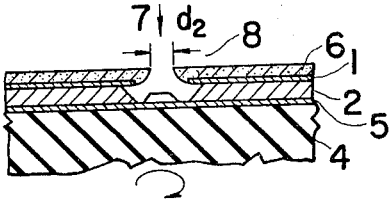
FIG. 3c PRIOR ART
Figure 3D:
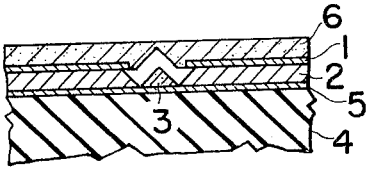
FIG. 3d PRIOR ART
Figure 3E:
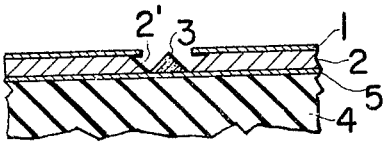
FIG. 3e PRIOR ART

Furthermore, a needlelike emitter with a sharp tip like that illustrated at FIG. 2*d* was formed under the islelike insulating layer 19 surrounded by the opening 16. Simultaneously, a minute cavity 18 was formed by sufficiently broadening the channel around the emitter 3 under the insulating layer 2, by etching the conductive substrate 4 employing the insulating layer 2 with the opening 16 of bottom side width $l_2$ as a mask. The insulating layer 2 and the conductive layer 1 was made to overhang the minute cavity 18 of the substrate 4 by generating a large opening 16' in said insulating layer 19.

Figure 4D:
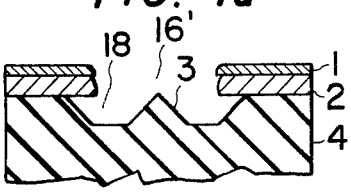

Finally, the resist film 9 was removed to thereby obtain a MFE according to the present invention, as illustrated in FIG. 4*d*.

As described above, it becomes possible to form a first anode 1 and an emitter 3 readily by only a series of etching steps. Since the emitter 3 was formed by the etching of the conductive substrate 4, there was no mixing of the mask material with the emitter as occurs in the previous method illustrated in FIGS. 3*a* to 3*e*. Therefore, electron emissions of high quality were obtained, and the manufacturing procedure could be simplified because of the lack of necessity of the removal of the mask material.

Furthermore, it becomes possible to remove many faults in the previous method as follows: there is no decrease of the dielectric breakdown voltage caused by contamination or the like because the insulating layer 2 disposed between the first anode 1 and the substrate 4 covers the lower surface of the first anode 1 and is so formed that it sufficiently overhangs the minute cavity 18 of the substrate 4 around the emitter 3.

EXAMPLE 2

Figure 5:
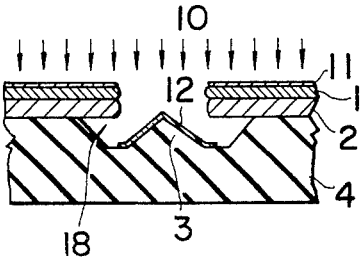
FIG. 5 is a diagrammatic illustration which explains a method of depositing material layers, having a low work function, on the MFE obtained by the method shown at FIGS. 4*a* to 4*d*.

As illustrated in FIG. 5, a MFE was manufactured according to the same method as Example 1, then $LaB_6$ particles 10 were vacuum-evaporated on the first anode 1 and the emitter 3 from a direction perpendicular to the surface of the substrate 4 to thereby form a first anode surface layer 11 and an emitter surface layer 12.

The resultant MFE had very good insulation between the substrate 4 and the first anode 1 because the insulating layer 2 made of $SiO_2$ overhung by more than 1 μm the minute cavity 18.

EXAMPLE 3

FIGS. 6*a* to 6*d* illustrate the method for manufacturing a MFE in this example.

Figure 6A:
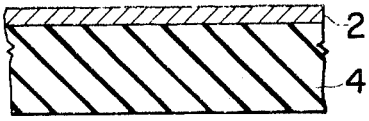
FIGS. 6*a* to 6*d* are cross-sectional views illustrating the structure of a MFE and the manufacturing steps thereof in another embodiment of the present invention.
Figure 6B:
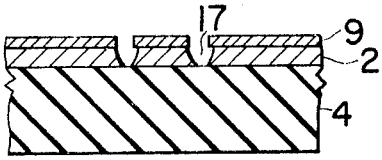
Figure 6C:
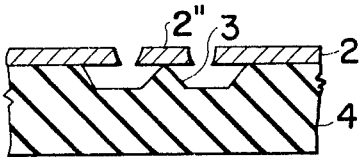

A $SiO_2$ insulating layer 2 of about 2 μm thickness was deposited on the substrate 4 made of a Si single crystal having a low specific resistivity, by the well known sputtering method, as shown at FIG. 6*a*. Then, a photo-resist film 9, which had a closed loop opening of a predetermined diameter and width at a predetermined position, was formed on the insulating layer 2. After that, the insulating layer 2 was etched, employing the photo-resist film 9 as a mask by the well known chemical etching method so as to form a closed circular loop opening 17 at a predetermined position in the surface of the insulating layer 2 thereby exposing the substrate 4 at the opening position 17 as illustrated in FIG. 6*b*. Next, the photo-resist film 9 was removed, and the substrate 4 was etched employing the etched insulating layer 2 as a mask by the well known chemical etching technique, thus forming a needlelike emitter with a sharp tip as shown at FIG. 6*c*. The islelike insulating layer 2'' over the emitter 3 fell off at this time.

Figure 6D:
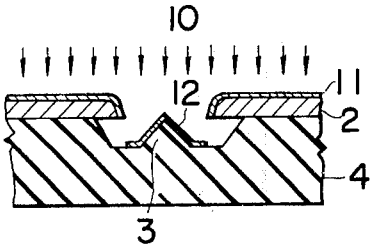

Finally, $LaB_6$ particles 10 were vacuum-evaporated on the insulating layer 2 and the emitter 3 from a direction perpendicular to the surface of the substrate 4 as shown in FIG. 6*d*, thereby forming the first anode 11. An improvement in the electron emissivity of the emitter was achieved simultaneously by the activation of the surface 12 of the emitter 3 namely by lowering the work function thereof. Thus, the desired MFE was manufactured.

EXAMPLE 4

Figure 7A:
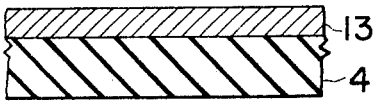
FIGS. 7*a* to 7*b* are cross-sectional views illustrating the structure of a MFE and the manufacturing steps thereof in still another embodiment of the present invention.
Figure 7B:
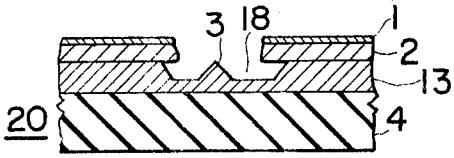

A $LaB_6$ layer 13 of about 10 μm thickness was formed on a sapphire substrate 4 as illustrated at FIG. 7*a*. Then, an insulating layer 2 and a conductive layer 1 used for a first anode were deposited on the $LaB_6$ layer 13. Next, the conductive layer 1, the insulating layer 2 and the composite substrate 20 were etched in this order by the same procedure as in Example 1 to form a needlelike emitter 3 and a cavity 18 over which the insulating layer 2 and the first anode layer 1 overhung. In this last step, the composite substrate 20 was so etched that the bottom of the cavity 18 around the emitter 3 did not reach the sapphire substrate 4. FIG. 7*b* illustrates the structure of the MFE thus manufactured.

EXAMPLE 5

The properties of the MFE's of the present invention were compared with those of previous MFE's in this example.

The MFE of the present invention used in this example had the structure illustrated in FIG. 4*d* and had a Si substrate 4 of 200 μm thickness, an emitter 3 having a height of 2.5 μm and a tip radium of curvature of 500 A, a $SiO_2$ insulating layer 2 of 2 μm thickness and a first anode 1 of 0.5 μm thickness made of Au. The previous MFE used in this example had the structure illustrated in FIG. 3*e* and had the same shape and thickness for each part as said MFE of the present invention, but it had no first conductive layer 5. Furthermore, both of the Si substrate faces had (111) crystalline planes. Mo was used for the emitter 3 and the first anode layer 1 of the previous MFE.

The atmospheres of these MFE's were made vacuum to $1 \times 10^{-7}$ Torr, accelerating voltage of 200 V was applied between the emitters and the first anodes, and the emitted electron rays were further accelerated by a high applied voltage of 4 kV between the emitters and second anodes arranged over the emitters at 10 cm. distance.

As a result, the measured emission current density of the MFE of the present invention was about $1 \times 10^5$ A/cm$^2$ which was 1.5 times that of the previous MFE which was about $6 \times 10^4$ A/cm$^2$. Furthermore, the stable working hours in which the emission current fluctuations were within ± 5% and wherein the intended emission currents were constantly 5 μA were measured at about 500 hours for the MFE of the present invention and at about 250 hours for the previous MFE. Therefore, the life of the MFE of this invention was twice as long as the life of the previous MFE. Still further, the dielectric breakdown voltages between the first anode and the emitter were measured, and the resultant measured values for the MFE of this invention and for the previous MFE were about 1,000 V and about 500 V, respectively, wherein the thickness of the insulating layers was 2 μm.

Desirable results were also obtained for MFE's having structures according to the other examples or drawings of this invention.

The reasons why MFE's having structures according to the present invention have superior properties are as follows:

1. Concerning the high dielectric breakdown voltage and the long life: the length of the surface of the insulating layer between the first anode 1 and the emitter 3 or the conductive substrate 4 is large, so that surface leakage and surface contamination during operation are minimal because the emitter side of the insulating layer 2 overhangs the minute cavity 18 as shown in FIG. 4*d*.

2. Concerning the long life: there occurs no inferiority at the portion where the emitter 3 is connected with the conductive substrate thereunder, because the emitter 3 and the conductive substrate 4 are comprised as one body.

3. Concerning the high emission current density: the upwards gradient of the electric field at the tip of the emitter is sharp under the application of voltage between the electrodes, because the tip of the emitter 3 is never higher than the bottom level of the first anode 1.

While the novel principles of the invention have been described, it will be understood that various omissions, modifications and changes in these principles may be made by one skilled in the art without departing from the spirit and scope of the invention.

What is claimed is:

1. A thin-film field-emission electron source comprising a conductive substrate having a minute cavity, a needlelike emitter within said cavity, an insulating layer on the surface of said substrate except for the portion of said cavity, and a first anode layer on said insulating layer, wherein said emitter and said substrate are formed as a single body, and said insulating layer and said first anode layer overhang said cavity around the projection of said emitter except over said emitter.

2. The thin-film field-emission electron source of claim 1, in which said substrate is composed of an insulating plate and a conductive layer formed on said insulating plate.

3. The thin-film field-emission electron source of claim 1, in which said substrate is made of a material selected from the group consisting of Si, W, W alloyed with Th, and Mo.

4. The thin-film field-emission electron source of claim 1, in which said insulating layer is made of a material selected from the group consisting of $SiO_2$, $TiO_2$, $Ta_2O_5$, $Y_2O_3$, $Si_3N_4$, AlN, alumina and heat resisting glass.

5. The thin-film field-emission electron source of claim 1, in which the surface of said emitter is coated with a material selected from the group consisting of (Ba,Sr)O, (BaO—SrO—CaO), (Ca,Sr)O, $LaB_6$, $CaB_6$, $SrB_6$, $BaB_6$, $CeB_6$, $(La,Sr)B_6$, $(La,Ba)B_6$, $(La,Eu)B_6$, $(Ce,Sr)B_6$, $(Ce,Ba)B_6$, $(Ce,Eu)B_6$, $(Pr,Sr)B_6$, $(Pr,Ba)B_6$, $(Pr,Eu)B_6$, $(Nd,Sr)B_6$, $(Nd,Ba)B_6$, $(Nd,Eu)B_6$, $(Eu,Sr)B_6$ and $(Eu,Ba)B_6$.

6. The thin-film field-emission electron source of claim 1, in which said first anode layer is made of a material selected from the group consisting of Cr, Au, Ni and their alloys.

7. The thin-film field-emission electron source of claim 5, in which the first anode layer is made of the same material as said surface of said coated emitter.

8. The method for manufacturing the thin-film field-emission electron source according to claim 1, comprising the steps: i) forming an insulating layer on a conductive substrate, ii) forming a first anode layer made of a conductive material on said insulating layer, iii) forming an annular opening at a predetermined position on said first anode layer by etching, iv) forming an annular opening on the face of said insulating layer under the opening provided in step iii) by etching said insulating layer employing said first anode layer as a mask, and v) forming a minute cavity and a needle-like emitter on said substrate by etching said substrate employing said insulating layer as a mask.

9. The method of claim 8, in which said insulating layer is formed by a chemical vapor deposition method.

10. The method of claim 8, in which said insulating layer is formed by a thermal oxydization method.

11. The method of claim 8, in which said insulating layer is formed by a sputtering method.

12. The method of claim 8, in which said first anode layer is formed by an evaporation method.

13. The method of claim 8, in which said etchings of steps iii), iv) and/or v) are carried out by chemical etching.

14. The method of claim 8, in which said etchings of steps iii), iv) and/or v) are carried out by physical etching.

15. The method of claim 8, further comprising a step of depositing an electron emissive material layer on said emitter after said step v).

16. A method for manufacturing the thin-film field-emission electron source according to claim 1, comprising the steps: i) forming an insulating layer on a conductive substrate, ii) forming an annular opening at a predetermined position on said insulating layer by etching, iii) forming a minute cavity and a needlelike emitter on said substrate by etching said substrate employing said insulating layer as a mask, and iv) depositing an electron emissive material layer on said insulating layer and said emitter.

17. The thin-film field-emission electron source of claim 1, in which the numbers of said cavities, said emitters and said first anode layers are plural.

18. The thin-film field-emission electron source of claim 1, in which the overhang of said insulating layer over said cavity is greater than 0.5 $\mu$m.

19. The thin-film field-emission electron source of claim 18, in which said overhang is greater than 1 $\mu$m.

* * * * *